US005426301A

United States Patent [19]

Turner

[11] Patent Number: 5,426,301

[45] Date of Patent: Jun. 20, 1995

[54] OFF-AXIS INTERFACE FOR A MASS SPECTROMETER

[76] Inventor: Patrick Turner, 61 Altrincham Road, Wilmslow, Cheshire SK9 5NH, United Kingdom

[21] Appl. No.: 142,359

[22] PCT Filed: May 21, 1992

[86] PCT No.: PCT/GB92/00925

§ 371 Date: Jan. 21, 1994

§ 102(e) Date: Jan. 21, 1994

[87] PCT Pub. No.: WO92/21139

PCT Pub. Date: Nov. 26, 1992

[30] Foreign Application Priority Data

May 21, 1991 [GB] United Kingdom ..... 9110960

[51] Int. Cl.[6] ..... H01J 49/26

[52] U.S. Cl. ..... 250/288; 250/281; 250/396 R

[58] Field of Search ..... 250/288, 288 A, 281, 250/282, 396 R, 396 ML

[56] References Cited

U.S. PATENT DOCUMENTS 4,746,794 5/1988 French ..... 250/288
4,999,492 3/1991 Nakagawa ..... 250/281
5,306,910 4/1994 Jarrell et al. ..... 250/288

FOREIGN PATENT DOCUMENTS 0161744 11/1985 European Pat. Off. .
0237259 9/1987 European Pat. Off. .
2225159 11/1988 United Kingdom .

OTHER PUBLICATIONS

Fishkova, T. Ya., et al., "Ion-optical System with Energy Filtering for Sputtering Neutral and Secondary Ion Mass Spectrometers", Nuclear Ints. . . , Dec. 1, 1990, pp. 179-180.

*Primary Examiner*—Paul M. Dzierzynski
*Assistant Examiner*—Kiet T. Nguyen
*Attorney, Agent, or Firm*—Spensley, Horn, Jubas & Lubitz

[57] ABSTRACT

A mass spectometer for analyzing a beam of ions generated from a sample of analyze comprises an analyzer (3) and an interface between the analyze sample (1) and the analyzer. The inlet aperture to the analyzer (13) is positioned off the axis of the ion beam (2) exiting the interface system, and a deflector is (14) provided to generate an electric field between the interface system and the analyzer to deflect the ion beam into the inlet aperture of the analyzer.

4 Claims, 2 Drawing Sheets

OFF-AXIS INTERFACE FOR A MASS SPECTROMETER

FIELD OF THE INVENTION

This invention relates to a mass spectrometer.

BACKGROUND OF THE INVENTION

Mass spectrometers are known instruments used to analyze the mass spectrum of a beam of ions generated from a specimen of material to be analyzed which is ionised in for example a plasma. The basic components of a standard mass spectrometer are an ion source, a mass analyzer such as a quadrapole, an interface for directing a beam of ions from the source to an inlet aperture of the analyzer, and a detector to detect the ions that pass through the analyzer. The interface includes a sampling cone through an aperture in which a beam of ions leaves the ion source.

In some mass spectrometers the cone aperture and the inlet aperture to the mass analyzer are in line on the axis of the analyzer, the analyze ions being focused using standard optics into a beam which travels along a straight path from the cone to the analyzer. Unwanted particles, such as neutral particles and photons, are removed from the analyze beam, before it enters the analyzer, using filters such as a Bessel Box. Such a system essentially comprises stops on the axis of the system and utilises standard optics to deflect the wanted ions around the stops before they are focused along the axis of the spectrometer. Such systems reduce, but do not eliminate, the number of unwanted particles that pass through the analyzer to be registered by the detector as "noise". It is also-known to position the detector off the axis of the analyzer and use standard optics to deflect ions exiting the analyzer towards the detector. Unwanted particles continue along the axis of the spectrometer.

Mass spectrometers of this general type have the disadvantage that they are often found to exhibit mass bias effects. The general form of this bias is a severe loss of transmission through the spectrometer of light elements. This is obviously an unsatisfactory situation in which to can carry out analytical measurements. These bias effects are essentially electrostatic in nature and arise from two distinct sources. Firstly, the optics of the Bessel Box, which bend wanted ions around stops, deflect lower energy particles to a greater degree than higher energy particles so that only a narrow energy band of particles which are of interest will pass through to the analyzer. As all particles enter the system from the source with similar velocities their energy will be dependent upon their mass. Hence only one mass of particles from the analyze ion beam will push through to the analyzer. The second source of mass bias arises from so called "space charge" effects. Positively charged ions in the analyze beam will repel each other with a normal Coulomb force. The effect of this is that some positive charged particles will be lost from the beam. Again it is the low mass low energy particles that are more likely to be lost.

To combat this problem, mass spectrometers have been built incorporating an accelerating electrode. This is typically in the form of an apertured cone situated behind standard sampling systems in the interface between the ion source and the mass analyzer. The ion beam from the source passes through the aperture in the cone which provides a strongly accelerated and convergent electrostatic field which acts upon the positively charged ions. The effect of this field is to squeeze incoming ions into a tight beam and rapidly transfer them from the sampling inlet to the analyzer inlet aperture, thus reducing any loss due to space charge effects. Such systems generally further comprise simple x, y deflection systems situated behind the accelerator cone to deflect the ion beam into the inlet aperture of a quadrapole mass analyzer which is situated off the axis of the ion beam as it emerges from the source. This dispenses with the need to employ for example a Bessel Box, as neutrals will not be bent by the x, y deflector and therefore will continue along the axis of the system and not enter the off axis mass analyzer. Systems of this sort have been shown to be effective in reducing noise levels and avoiding mass bias effects.

Most of the noise still picked up by detectors in such systems is generally attributed to stray photons. However, tests have shown that many unwanted counts result from neutral particles entering the mass analyzer. The source of these neutral particles may be positive ions in the analyze beam which collide with residual gas particles in the system and thus undergo a process of charge exchange resulting in the formation of neutral particles.

Systems such as the one described above which employ a particle accelerating electrode are particularly susceptible to this problem This is because the ions are decelerated in the vicinity of the inlet aperture to the mass analyzer, where there exists a relatively high pressure region in which the likelihood of collisions between analyze ions and residual gas particles is increased. Because this takes place close to the inlet aperture to the analyzer almost all the neutral particles resulting from charge exchange in this region will enter the analyzer. It is an object of the present invention to obviate or mitigate these disadvantages.

SUMMARY OF THE INVENTION

According to the present invention there is provided a mass spectrometer for analyzing a beam of ions generated from a sample of analyze, comprising an ion source for generating a beam of ions from the sample, an accelerator for accelerating the ion beam, an interface comprising a lens system arranged to focus the accelerated ion beam and a deflector system for deflecting the accelerated ion beam, a decelerator for decelerating the ion beam exiting the interface, and an analyser for analyzing the decelerated ion beam, wherein the analyser has an inlet aperture which is located off the axis of the ion beam exiting the interface system, and the decelerator comprises means for generating an electric field to deflect the ion beam exiting the interface into the analyser inlet aperture.

Preferably, the electric field is generated by an electrically conductive plate positioned so as to extend from adjacent one side of the aperture towards the interface. The ion beam is deflected to emerge from the interface in a off-axis direction which if maintained would be directed across the aperture towards the plate. Positive ions in the beam will be deflected to the aperture, whereas neutrals will not be deflected and will not therefore enter the inlet aperture.

Beam deflection may be achieved using conventional x-y deflectors located adjacent the source end of the interface. In addition, auxiliary deflectors may be positioned adjacent the analyzer end of the interface to further adjust the angle between the analyzer axis and the beam of ions emerging from the interface.

BRIEF DESCRIPTION OF THE DRAWINGS

A specific embodiment of the invention will now be described, by way of example, and with reference to the accompanying drawings, in which.

DETAILED DESCRIPTION OF PREFERRED EMBODIMENT(S)

Figure 1:
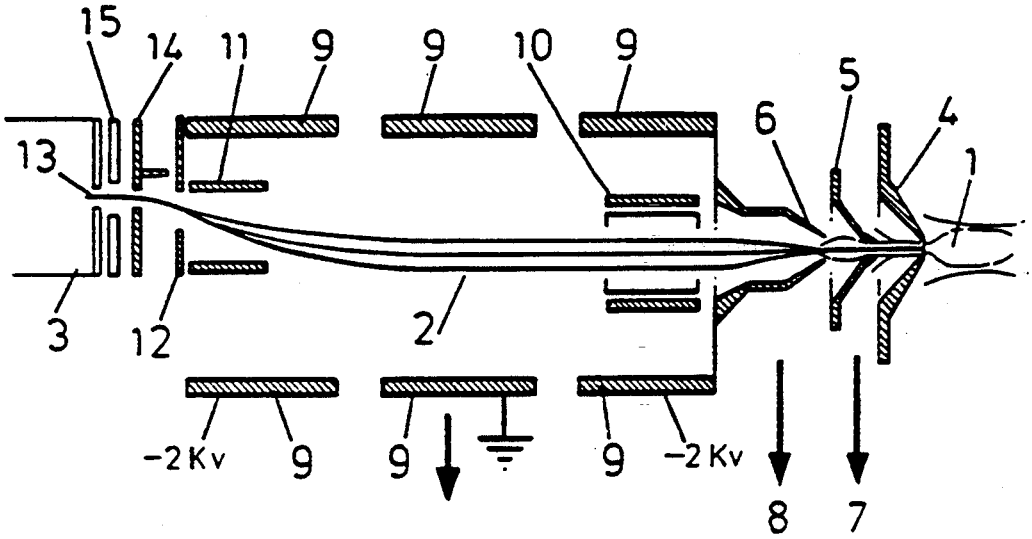
FIG. 1 is a schematic representation of a mass spectrometer system according to the present invention.

Referring to the drawings, the illustrated mass spectrometer comprises an ion source (not shown) in which a specimen of material to be analyzed is first ionised within a plasma 1 in a standard manner. A beam of ions 2 is generated and passes through an interface in a focused beam to the entrance of a quadrapole mass analyzer 3. The interface system comprises an inlet system, a beam path deflection system and a focusing system.

The inlet system comprises a sampling cone 4, a skimmer cone 5, an accelerating cone 6, an expansion rotary pump evacuating the space between the cones 4 and 5 as indicated by arrow 7, and an intermediate turbo molecular pump evacuating the space between cones 5 and 6 indicated by arrow 8. The structure and function of the cones 5 and 6, and of the pumps is standard and well known in the art. The function of the accelerator, which is held at for example −2 KV, is to accelerate the incoming ions.

The focusing system comprises a series of electrostatic lenses 9 negative and utilises standard optics to focus the analyze ion beam. The lenses 9 nearest each end of the interface system are held at −2 KV, and the central lenses 9 are grounded.

The beam path deflection system is a conventional arrangement and comprises XY deflectors 10 situated behind the accelerator cone 6 to deflect the analyze ion beam off the axis of the interface system. Neutral particles emerging from the source are thus eliminated from the ion beam. Additional Y deflectors 11 are situated at the exit of the standard interface system to deflect the ion beam onto a path even more steeply inclined to the axis of the mass analyzer 3 before leaving the interface system. Thus the beam emerging from the interface through an aperture in an end plate 12 is inclined to the analyzer axis and directed towards a point above an inlet aperture 13 of the analyzer. Any neutral particles in the beam emerging from the plate 12 will thus not enter the aperture 13. An aperture deflector plate 14 and a conventional phase matching lens 15 are positioned between the plate 12 and the analyzer. The plate 14 is held at ground potential whereas the plate 12 is held at −2 KV. Thus, ions leaving the plate 12 are decelerated. Furthermore, an extension plate extends from the plate 14, and is also maintained at ground potential. Thus, the decelerated ions are deflected towards the aperture 13.

Figure 2:
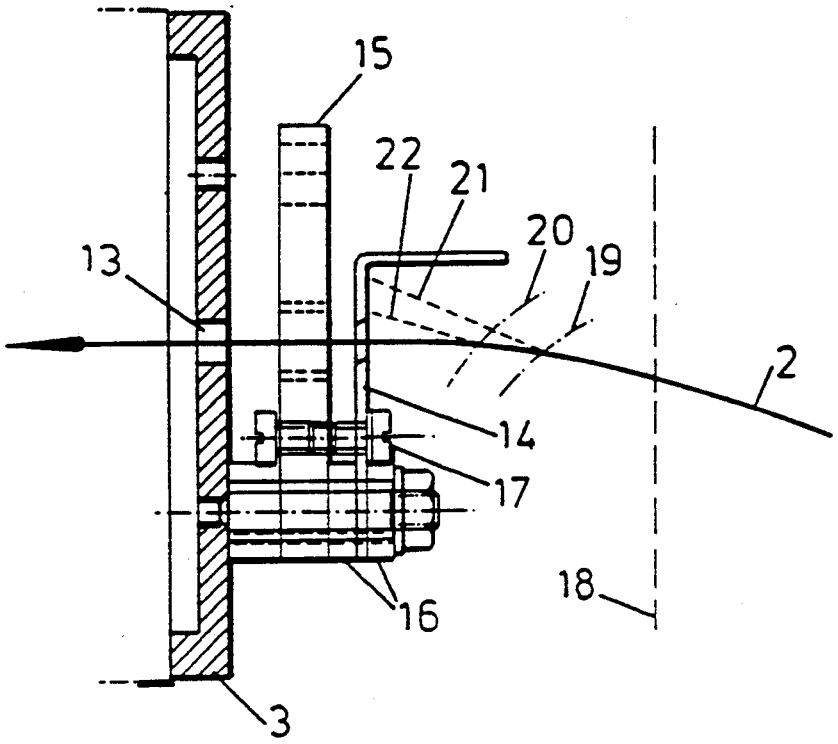
FIG. 2 illustrates a detail of the embodiment shown in FIG. 1.

Referring now to FIG. 2, this illustrates in greater detail the components immediately adjacent the inlet aperture of the analyzer. The same reference numerals are used where appropriate in FIGS. 1 and 2. The apertured plate 14 and phase match lens 15 are supported on an end plate of the analyzer 3 in which the inlet aperture 13 is defined. The ion beam entering the analyzer is indicated by line 2.

The plate 14 is secured between insulating bushes 16 and earthed via terminal 17. A broken line 18 indicates the axial position of the negative end plate 12 shown in FIG. 1. Thus the ion beam crosses imaginary equipotential surfaces indicated roughly by broken lines 19 and 20 and is deflected accordingly. Any neutral generated at line 19 follows the path indicated by broken line 21, whereas any neutral generated at line 20 follows the path indicated by broken line 22. Thus substantially all the neutrals contained in the beam 2 as it leaves the interface or generated upstream of the plate 14 do not reach the analyzer aperture 13.

Experiments conducted with a mass spectrometer of the type described above have shown reduction in noise of from 10 to 100 fold. Thus the simple deflector arrangement immediately upstream of the analyzer has a remarkable effect upon system sensitivity. It will be appreciated that this technique would be used to advantage in arrangements different from that described. For example, benefits would still arise even if the beam 2 of FIG. 2 emanated from a standard on-axis interface relying upon for example a Bessel Box for limited neutral particle rejection.

I claim:

1. A mass spectrometer for analyzing a beam of ions generated from a sample of analyze, comprising an ion source for generating the beam of ions from the sample, an accelerator for accelerating the ion beam, an interface comprising a lens system arranged to focus the accelerated ion beam and a deflector system for deflecting the accelerated ion beam, a decelerator for decelerating the ion beam exiting the interface, and an analyser for analyzing the decelerated ion beam, wherein the analyser has an inlet aperture which is located off the axis of the ion beam exiting the interface system, and the decelerator comprises means for generating an electric field to deflect the ion beam exiting the interface into the analyser inlet aperture.

2. A mass spectrometer according to claim 1, wherein said means for generating said electric field comprises an electrically conductive plate positioned so as to extend from the analyzer towards the interface.

3. A mass spectrometer according to claim 1 or 2, wherein said deflection system comprises x-y deflection plates are located adjacent the end of the interface nearest the ion source to deflect the ion beam off the axis of the interface.

4. A mass spectrometer according to any preceding claim 1 or 2, wherein said deflector system comprises y deflector plates are located adjacent the end of the interface nearest the analyzer to deflect the ion beam into a path inclined to the axis of the analyzer.

* * * * *